United States Patent [19]

Dreckmann et al.

[11] Patent Number: 5,000,728

[45] Date of Patent: Mar. 19, 1991

[54] METHOD OF AND APPARATUS FOR STACKING BAG SEGMENTS

[75] Inventors: Karl Dreckmann, Hennef-Altenbödingen; Jakob Schneider, Niederkassel-Mondorf, both of Fed. Rep. of Germany

[73] Assignee: Lemo M. Lehmacher & Sohn GmbH Maschinenfabrik, Niederkassel-Mondorf, Fed. Rep. of Germany

[21] Appl. No.: 425,719

[22] Filed: Oct. 23, 1989

Related U.S. Application Data

[63] Continuation-in-part of Ser. No. 205,432, Jun. 10, 1988, abandoned.

[51] Int. Cl.[5] ..... B65H 9/02; B65H 9/08; B65H 29/40

[52] U.S. Cl. ..... 493/227; 493/194; 493/201; 493/210; 493/226; 493/204

[58] Field of Search ..... 493/194, 201, 210, 227, 493/204, 226, 480, 926

[56] References Cited

U.S. PATENT DOCUMENTS

| | | | |
|---|---|---|---|
| 3,633,731 | 1/1972 | Jones | 493/204 |
| 4,657,528 | 4/1987 | Achelpohl | 493/204 |
| 4,735,602 | 5/1988 | DeBin | 493/204 |
| 4,796,499 | 1/1989 | Achelpohl | 493/194 |

FOREIGN PATENT DOCUMENTS

| | | | |
|---|---|---|---|
| 3138221 | 7/1984 | Fed. Rep. of Germany . | |
| 3619933 | 10/1987 | Fed. Rep. of Germany | 493/204 |

*Primary Examiner*—Frederick R. Schmidt
*Assistant Examiner*—Jack W. Lavinder
*Attorney, Agent, or Firm*—Herbert Dubno

[57] ABSTRACT

Bag segments arriving one after the other in a travel direction at an upstream input station are first lifted one by one as they arrive at the input station, are inverted them, and are deposited in a stack at a downstream stacking station atop one of a pair of similar pin-type stacking carriages held at an upper level. The one stacking carriage and the stack carried thereby are periodically displaced downstream from the stacking station to a downstream station at the upper level and the other stacking carriage is raised in the stacking station from a lower level below the one carriage to the upper level with the one carriage such that the segments are subsequently deposited on the other carriage in the stacking station. The one carriage is then lowered in the downstream station from the upper level to the lower level to strip off the stack it carries and thereafter is displaced at the lower level back upstream to the stacking station.

10 Claims, 5 Drawing Sheets

METHOD OF AND APPARATUS FOR STACKING BAG SEGMENTS

CROSS REFERENCE TO RELATED APPLICATION

This application is a continuation-in-part of copending patent application Ser. No. 205,432 filed June 10, 1988 now abandoned.

FIELD OF THE INVENTION

The present invention relates to the manufacture of handled shopping bags. More particularly this invention concerns an apparatus for forming uniform stacks of bag segments or blanks and a method of operating the apparatus prior to punching out the stack to form bags.

BACKGROUND OF THE INVENTION

A standard synthetic-resin shopping bag is formed by cutting a continuously arriving tube into a succession of short segments or blanks in such a manner that usually the leading and trailing edges of the blanks are sealed. These blanks are then stacked up and an edge is punched out to form a fill opening and a pair of handles, or the center of such a blank can be punched out to form two such bags. Stacking holes might also be punched in the bags so they can be dispensed conveniently from a carry pin.

The standard stacking apparatus comprises a pair of parallel wheels centered on a common horizontal axis that is perpendicular to the displacement direction of the arriving bag segments on an input conveyor. Each wheel has an array of radially projecting suction arms and the wheels are rotated synchronously to bring two arms up underneath a single bag segment on the input conveyor then carry it up and over, inverting it and depositing it on a stack immediately downstream.

This stack is formed as described in German patent document 3,138,221 of R.F. Bin (based on a Belgian priority of 16 Sep 1980) atop a belt or chain conveyor which is provided with stacking pins on which the bags are impaled. The conveyor moves in steps so that the stacking operation must be interrupted each time the stack is carried downstream to the punching machine. Thus each time the stack is carried away the upstream stacker must miss one cycle, or even two cycles when its cycling speed is high compared to the cycle speed of the conveyor.

Another disadvantage of this known machine is that it can normally only operate on machines which produce dual head-to-head bags. It cannot be adapted to the manufacture of standard separate handled-typed shopping bags, that is with a sack body from the top edge of which extend two parallel loop handles. Furthermore this known machine and most of the other standard such machines require continuous operator supervision of and/or intervention in the process.

The following U.S. patents are commonly owned with the present case and relate to bag making and stacking: U.S. Pat. Nos. 4,631,047, 4,695,346, 4,614,472, 4,512,757, 4,552,551, and 4,536,174

OBJECTS OF THE INVENTION

It is therefore an object of the present invention to provide an improved method of and apparatus for stacking and transporting bag segments.

Another object is the provision of such an improved method and apparatus for stacking and transporting bag segments which overcomes the above-given disadvantages, that is which rapidly and accurately stacks bags and transports them downstream without interrupting the segment feeder.

SUMMARY OF THE INVENTION

A method of handling bag segments arriving one after the other in a travel direction at an upstream input station comprises the steps of first lifting the segments as they arrive at the input station, inverting them, and depositing them in a stack at a downstream stacking station atop one of a pair of similar pin-type stacking carriages held at an upper level. The one stacking carriage and the stack carried thereby are periodically displaced downstream from the stacking station to a downstream station at the upper level and the other stacking carriage is raised in the stacking station from a lower level below the one carriage to the upper level with the one carriage such that the segments are subsequently deposited on the other carriage in the stacking station. The one carriage is then lowered in the downstream station from the upper level to the lower level to strip off the stack it carries and thereafter is displaced at the lower level back upstream to the stacking station.

Our invention attains a considerable increase in output performance and consequently can be used with an automatic bag machine having a very high cycling rate because the pin stacker is equipped with two stack carriages which alternately to receive the bags and, when full, carry the stack away so as to eliminate the idle time which in the known apparatus must be tolerated when the belt or chain conveyor which carries the stack pins is moved.

Lowering of the pin plates strips the stack automatically from the stack pins. In addition a precise positioning of the stack carriages and their stacking pins is possible. Of particular advantage is the fact that the apparatus according to our invention can stack and further process single-bag segments as well as double-bag segments as is discussed below.

According to a feature of this invention the segments are deposited on the carriages such that they hang down on either side thereof. The hanging-down side portions of the segments of the bags of the stack are lifted such that the stack is oriented mainly horizontal. The leading edge of the stack after it is stripped off the respective carriage is gripped to pull the stack by its leading edge into a punching station where the stack is punched to complete the formation of the bags. For the sake of neatness in the punching station a portion of the stack is punched out which corresponds to the portion engaged by the pins of the transfer carriage in the stacking and transfer stations.

The apparatus of this invention therefore has a pair of substantially identical stacking carriages each having at least one upstanding stacking pin. These carriages are each vertically displaceable between an upper and a lower level and horizontally displaceable between the stacking station downstream of the input station and the spreading/transfer station downstream of the stacking station. A transfer wheel between the stacking and input stations has suction arms movable between the stations for lifting the segments as they arrive at the input station, inverting them, and depositing them in a stack at the stacking station atop whichever of the stacking carriages is there and at the upper level.

Each carriage is formed by a horizontal bar and a pair of such stacking pins projecting upward from the bar and spaced apart in the direction. Furthermore according to the invention the apparatus includes a generally stationary stripper bar at the transfer station immediately adjacent the bar of the carriage in the upper level thereat. Thus the bags are stripped off on the stripper bar when the carriage drops in the transfer station. The stacking wheel deposits the bag segments in the stacking station such that their side portions hang downward on each side of the respective carriage so that a pair of spreader elements at the transfer station displaceable transversely of the direction between an inner position immediately adjacent the carriages at the transfer station and an outer position spaced laterally therefrom can lift the side portions of the downwardly hanging bag segments.

According to this invention a gripper having a pair of horizontally transversely extending and vertically spaced jaws can grip the downstream leading edge of the stack in the transfer station.

DESCRIPTION OF THE DRAWING

The above and other objects, features, and advantages will become more readily apparent from the following, reference being made to the accompanying drawing in which.

SPECIFIC DESCRIPTION

Figure 1:
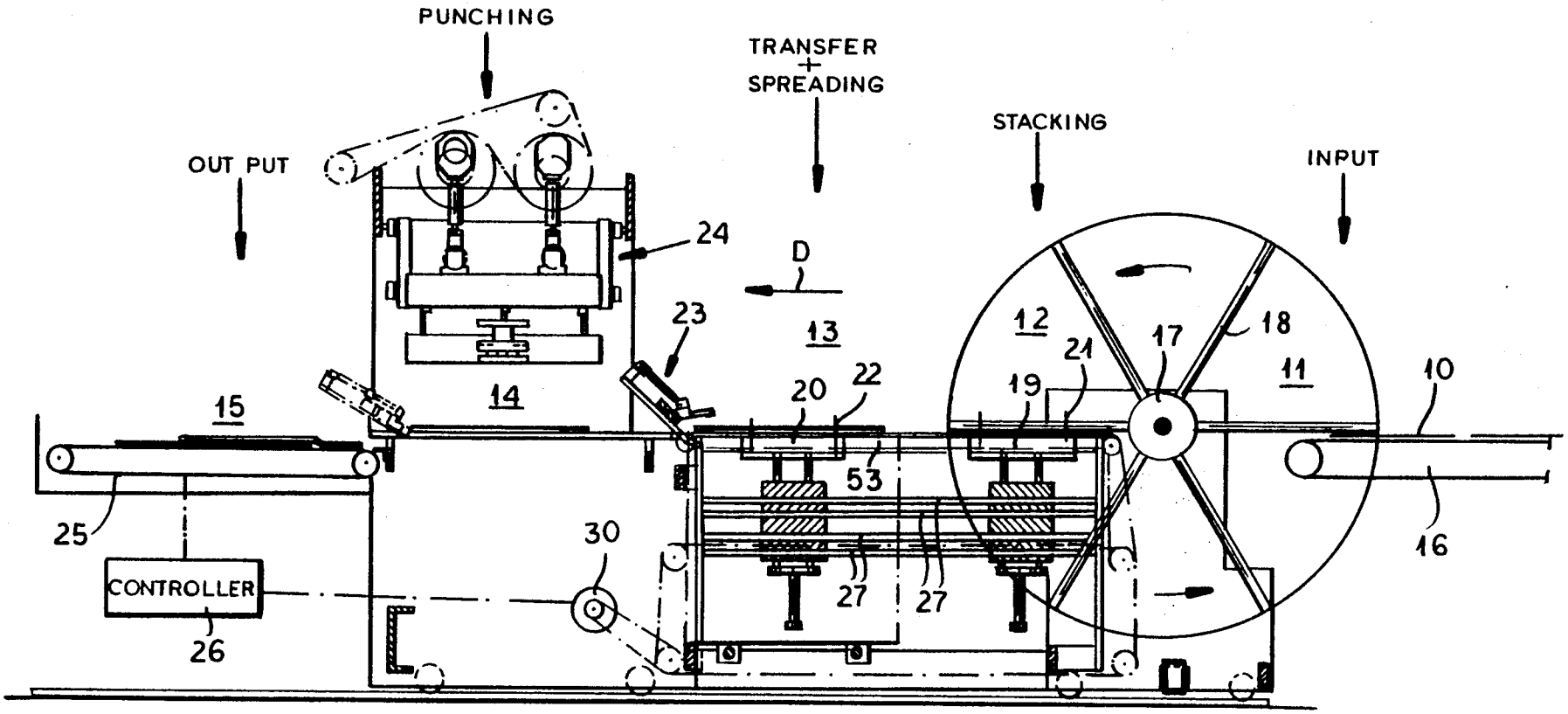
FIG. 1 is a small-scale partly schematic side view of an apparatus carrying out the method of this invention.
Figure 2:
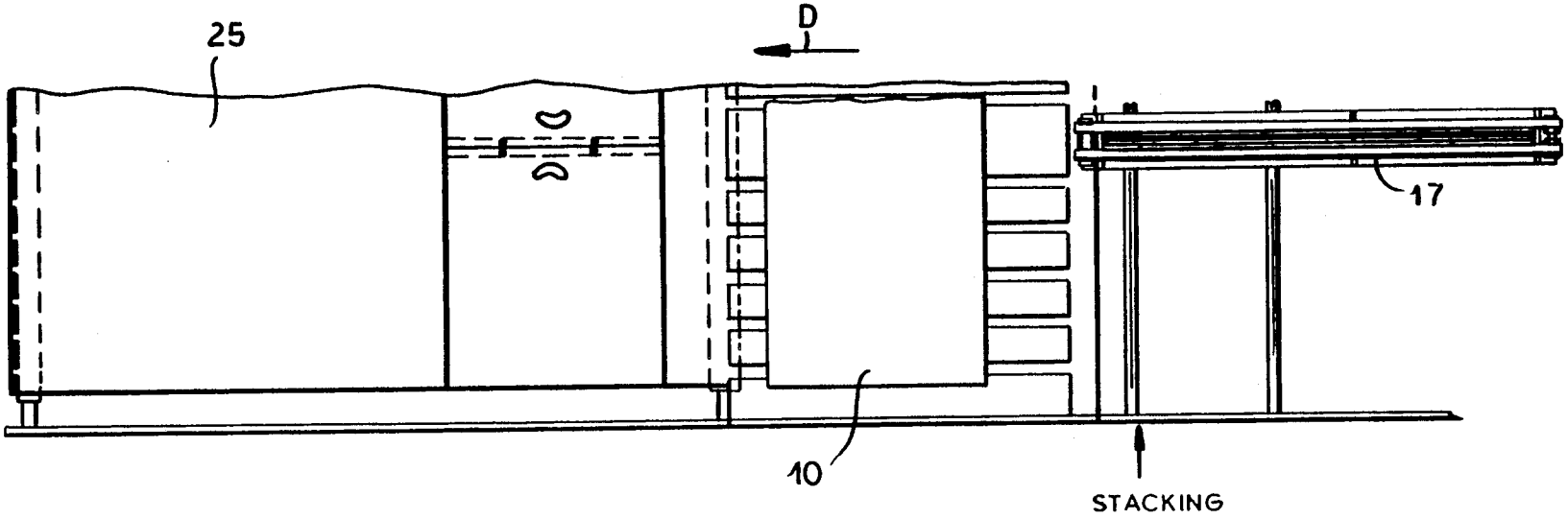
FIG. 2 is a top view of the apparatus of FIG. 1 with some parts removed for clarity of view.

As seen in FIGS. 1 and 2 a succession of identical bag segments or blanks 10 are fed in a transport direction D by a conveyor 16 to an upstream input station 11. Thence they are passed by arms 18 of a pair of suction-type stacking wheels 17 to a stacking station where they are loaded in a stack atop one of two transfer carriages 19 or 20 equipped with stacking pins 21 and 22 and are moved downstream to a transfer and spreading station 13. A gripper 23 can pull the stack of segments 10 from the station 13 into a punching station 14 where a dual-bag punch 24 cuts out handholes and forms a center perforation, and thence the gripper 23 pulls them into an output station where the stacks are deposited shingle-fashion atop a conveyor 25. A controller 26 is connected to various belt drives, pneumatic cylinders, sensors, and the like in the equipment to synchronize all the above-described actions.

Figure 5:
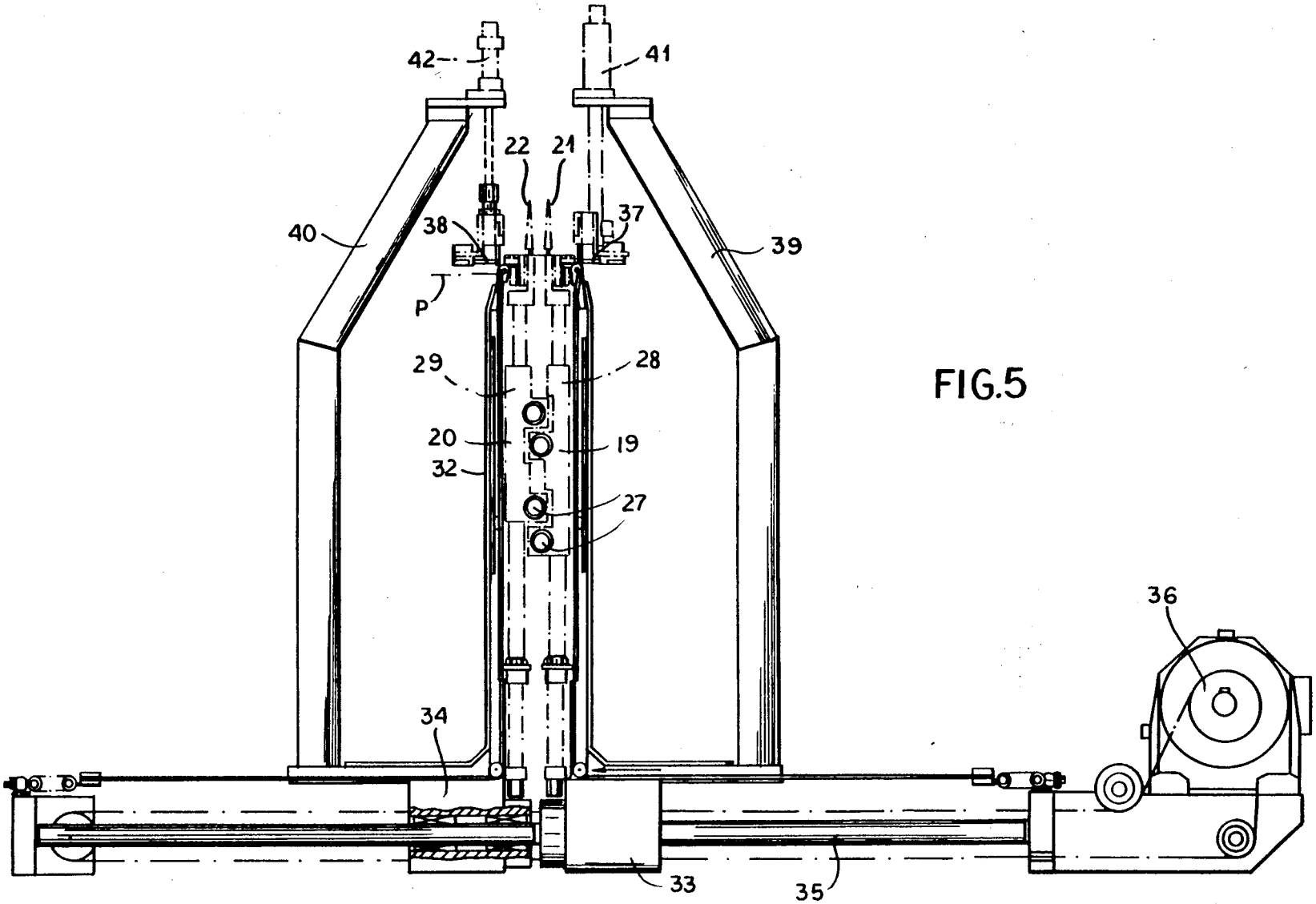
FIG. 5 is an end view of the spreading unit.

The carriages 19 and 20 are carried on four vertically spaced guide bars 27 and are set up so that they can pass one another as shown in better detail in FIG. 5. In addition they are provided with respective pneumatic cylinders 28 and 29 so that they can be moved between the raised position illustrated in the drawing and a lowered position where the upper ends of their stacking pins 20 and 21 lie below an upper-level plane P. Respective motors 30 (only one shown in phantom lines in FIG. 1) operated by the controller 26 can displace these carriages 19 and 20 independently of each other between end positions in the stations 12 and 13. In fact these two carriages 19 and 20 shuttle alternately back and forth, moving downstream in direction D while at the upper level P and moving back upstream at a lower level.

The spreading station 13 is provided as seen in FIG. 5 with a pair of spreader plates 31 and 32 supported on blocks 33 and 34 on rails 35 and operated for joint but opposite movement perpendicular to the direction D by a drive 36 in turn operated by the controller 26. These plates 31 and 32 have horizontal upper edges extending in the direction D and lying just at the plane P and cooperate with respective bumpers or brushes 37 and 38 suspended from outriggers 39 and 40 and vertically displaceable by cylinders 41 and 42 thereon. The outriggers 39 and 40 have lower ends fixed on the blocks 33 and 34 for joint movement with the respective spreader plates 31 and 32 all, of course, under the control of the controller 26.

Figure 4:
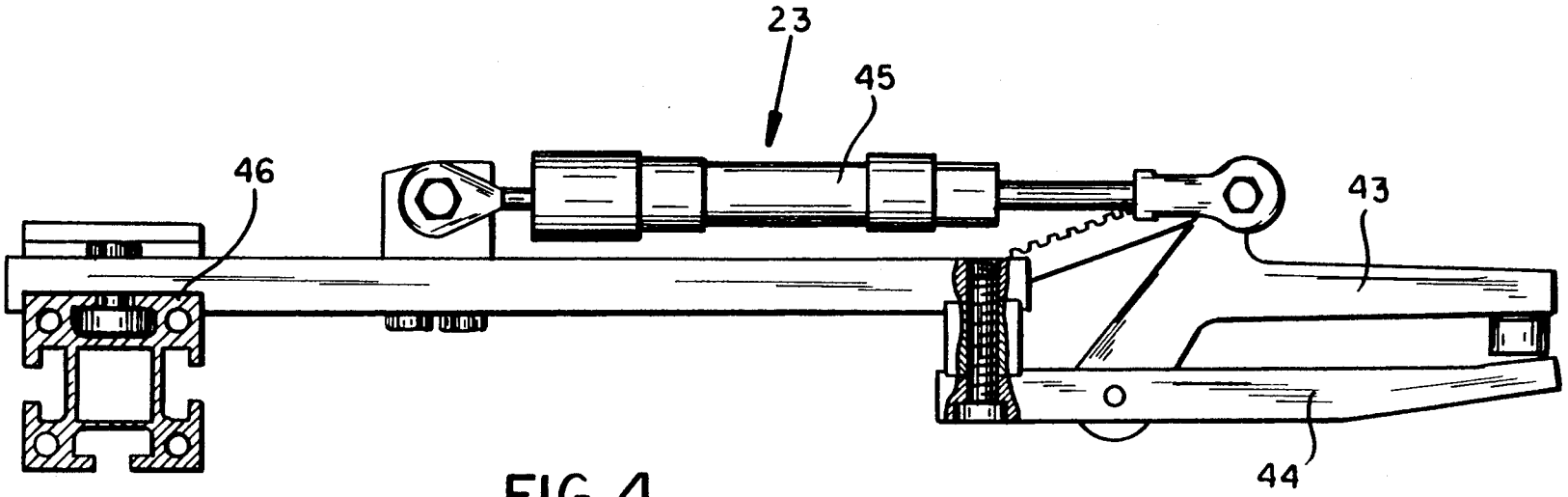
FIG. 4 is a larger-scale side view of the gripper.

The gripper 23 comprises as seen in FIG. 4 an upper jaw 43 and a lower jaw 44 that extend the full width of the machine horizontally perpendicular to the direction D and that can be spread or closed vertically by a small cylinder 45. This gripper 23 is carried on a support 46 that can be moved by an appropriate drive from the upstream position at the downstream end of the station 13 to a downstream position in the station 15, once again as determined by the controller 26.

Figure 3:
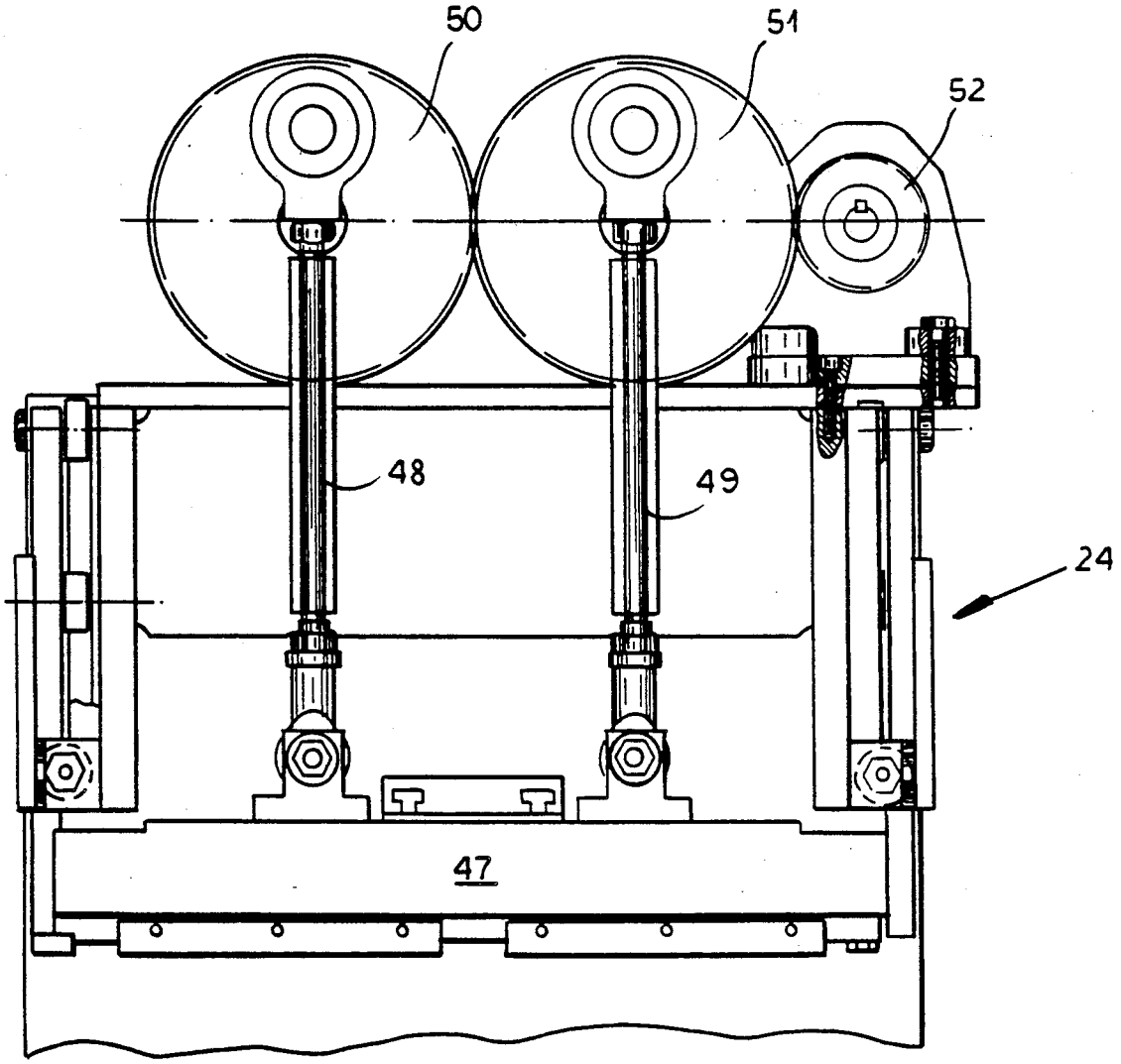
FIG. 3 is a larger-scale side view of the punching unit of the apparatus.

The punching unit 24 as seen in FIG. 3 has a vertically displaceable punch 47 carried via rods 48 and 49 on a pair of eccentrics 50 and 51 in turn operated by yet another drive 52. Thus this punch 47 can be vertically reciprocated.

According to this invention the bag segments 10 arrive continuously, one at a time, at the station 10 and the wheels 17 rotate relatively rapidly so that each segment 10 is picked up as a pair of the arms 18 sweep up past the sides of the conveyor 16. As the wheels 17 rotate, therefore, the picked-up segment 10 is inverted and is deposited in the station 12 on the carriage 19 therein, impaling it on the two pins 21. This leaves each bag segment 10 fixed but draped over the upstream carriage 10 with a substantial side portion hanging down therefrom on each side.

Once the stack has a sufficient number of segments in it the appropriate drive 30 pulls the carriage 19 with the stack downstream in the direction D to the station 13 and, as soon as this carriage 19 is clear of the station 12, the other carriage 20 is raised in the station 12 to take its place. This takes place very rapidly so that there is no need to interrupt the flow of incoming bag segments 10, that is this operation takes less time than the time between the arrival of succeeding bag segments 10.

Once the stack is in the station 13 the cylinders 41 and 42 push their brushes 37 and 38 down to press the inner portions of the downwardly hanging side portions of the bags blanks 10 against the top edges of the plates 31 and 32, and then the drive 36 pulls the two plates 31 and 32 and their brushes 37 and 38 outward about 30 cm. This action fans or spreads the downwardly U-shaped stack of bag segments and smoothes them, giving the stack a horizontally flat shape.

Once this flat shape is assumed the gripper 23 is moved into the solid-line upstream position and its jaws 43 and 44 are closed on the now straight downstream leading edge of the stack, the carriage 19 is dropped downward to strip the stack off against a stripper bar 53, and this gripper 23 is pulled back to the dot-dash position of FIG. 1. This action leaves the stack of bag segments 10 lying flat in the punching unit 24.

The punch 47 is then lowered to cut a center perforation, two new stack holes, and to punch out two hand holes, and then the punching unit 24 opens and the stack of double bags is pulled out and deposited in the station 15 on the conveyor 25. The punching unit 24 can, of course, also be used to form single bags by simply punching out a section of one side of the stack, preferably where the pins 21 or 22 projected through them.

We claim:

1. A method of handling bag segments arriving one after the other in a travel direction at an upstream input station, the method comprising the steps of:

(a) lifting the segments as they arrive at the input station, inverting them, and depositing them in a stack at a downstream stacking station atop one of a pair of similar pintype stacking carriages held at an upper level;

(b) periodically simultaneously reciprocating the one stacking carriage and the stack carried thereby downstream from the stacking station to a downstream station at the upper level and vertically raising the other stacking carriage in the stacking station from a lower level below the one carriage to the upper level with the one carriage such that the segments are subsequently deposited on the other carriage in the stacking station; and (c) vertically lowering, the one carriage in the downstream station from the upper level to the lower level to strip off said stack and thereafter reciprocating the one carriage at the lower level back upstream to the stacking station.

2. The method defined in claim 1 wherein the segments are deposited on the carriages in step (a) such that they hang down on either side thereof, the method further comprising the step after step (a) and before step (b) of (a') lifting the hanging-down side portions of the segments of the bags of the stack such that the stack is oriented mainly horizontal.

3. The method defined in claim 2 wherein the downstream station is a transfer station, the method further comprising the steps of:

(d) gripping the leading edge of the stack after it is stripped off the respective carriage and pulling the stack by its leading edge into a punching station; and (e) punching the stack in the punching station.

4. The method defined in claim 3 wherein in the punching station a portion of the stack is punched out which corresponds to the portion engaged by the pintype carriage in the stacking and transfer stations.

5. An apparatus for handling a succession of bag segments arriving one after the other in a travel direction at an upstream input station, the apparatus comprising:

a pair of substantially identical stacking carriages each having at least one upstanding stacking pin, the carriages each being vertically displaceable between an upper and a lower level and horizontally displaceable between a stacking station downstream of the input station and a transfer station downstream of the stacking station;

means including a transfer wheel between the stacking and input stations and having suction arms movable between the stations for lifting the segments as they arrive at the input station, inverting them, and depositing them in a stack at the stacking station atop a one of a pair of the stacking carriages at the upper level;

control and drive means connected to the carriages for periodically reciprocating the one stacking carriage and the stack carried thereby downstream from the stacking station to the transfer station at the upper level and vertically raising the other stacking carriage in the stacking station from the lower level to the upper level such that the segments are subsequently deposited by the wheel on the other carriage in the stacking station and for vertically lowering the one carriage in the downstream station from the upper level to the lower level to strip off the stack it carries and thereafter reciprocating the one carriage at the lower level back upstream to the stacking station while a new stack is being formed on the other carriage.

6. The apparatus defined in claim 5 wherein each carriage is formed by a horizontal bar, and a pair of stacking pins projecting upward from the bar and spaced apart in the direction.

7. The apparatus defined in claim 6 wherein the apparatus includes a generally stationary stripper bar at the transfer station immediately adjacent the bar of the carriage in the upper level thereat, whereby the bags are stripped off the stripper bar when the carriage drops in the transfer station.

8. The apparatus defined in claim 6 wherein the stacking wheel deposits the bag segments in the stacking station such that their side portions hang downward on each side of the respective carriage, the apparatus further comprising means including a pair of spreader elements at the transfer station displaceable transversely of the direction between an inner position immediately adjacent the carriages at the transfer station and an outer position spaced laterally therefrom for lifting the side portions of the downwardly hanging bag segments.

9. The apparatus defined in claim 8 wherein the control means includes a gripper having a pair of horizontally transversely extending and vertically spaced jaws grippable on the downstream leading edge of the stack in the transfer station.

10. The apparatus defined in claim 9, further comprising means at the punching station for punching through the stack and forming the stack of bag segments into a stack of bags.

* * * * *